US005988493A

United States Patent [19]

Clougherty

[11] Patent Number: 5,988,493

[45] Date of Patent: Nov. 23, 1999

[54] COMPOSITE CONTAINER FOR VACUUM PACKAGING OF PRODUCTS

[75] Inventor: Kenan J. Clougherty, Hartsville, S.C.

[73] Assignee: Sonoco Development, Inc., Hartsville, S.C.

[21] Appl. No.: 09/055,808

[22] Filed: Apr. 6, 1998

[51] Int. Cl.[6] ..... B65D 3/10

[52] U.S. Cl. ..... 229/164.2; 229/4.5; 229/5.5; 220/62.21; 220/62.22; 220/62.18; 206/524.8

[58] Field of Search ..... 220/62.22, 62.21, 220/62.18, 592.27; 206/524.8; 229/4.5, 164.2

[56] References Cited

U.S. PATENT DOCUMENTS

| | | | |
|---|---|---|---|
| 3,083,889 | 4/1963 | Christensson | 206/524.8 |
| 3,171,571 | 3/1965 | Daniels . | |
| 3,610,455 | 10/1971 | Greenhaigh et al. . | |
| 3,828,608 | 8/1974 | Yamamoto . | |
| 4,004,727 | 1/1977 | Rausing et al. | 229/4.5 |
| 4,098,404 | 7/1978 | Markert | 206/524.8 X |
| 4,158,425 | 6/1979 | Sansbury | 220/461 |
| 4,184,608 | 1/1980 | Christensson | 206/524.8 X |
| 4,343,427 | 8/1982 | Sansbury . | |
| 4,466,553 | 8/1984 | Zenger | 206/524.8 X |
| 4,525,396 | 6/1985 | Takasa et al. | 229/4.5 X |
| 4,658,989 | 4/1987 | Bonerb . | |
| 4,690,299 | 9/1987 | Cannon . | |
| 5,285,954 | 2/1994 | Goglio | 206/524.8 X |
| 5,424,086 | 6/1995 | Walker | 206/524.8 X |
| 5,435,452 | 7/1995 | Nishigami et al. | 215/12.1 |
| 5,465,863 | 11/1995 | Seick et al. . | |
| 5,494,215 | 2/1996 | Drummond et al. . | |
| 5,513,761 | 5/1996 | Kobayashi et al. . | |
| 5,522,523 | 6/1996 | Nogles . | |
| 5,547,451 | 8/1996 | Drummond et al. . | |
| 5,556,365 | 9/1996 | Drummond et al. . | |
| 5,628,404 | 5/1997 | Hendrix | 206/524.8 |
| 5,799,818 | 9/1998 | Ringer | 220/62.21 |

*Primary Examiner*—Gary E. Elkins
*Assistant Examiner*—Tri M. Mai
*Attorney, Agent, or Firm*—Alston & Bird LLP

[57] ABSTRACT

A composite container is provided for vacuum packaging of products which is constructed, as follows. A hollow body portion defines a desired shape for the container and has an inside surface. A liner layer is in superimposed position within the body portion and covers the inside surface for receiving the product inside the liner layer and the body portion of the container. An elastic material is positioned between the body portion and the liner layer for movably attaching the liner layer to the body portion in the superimposed position while allowing the liner layer to constrict and move away from the body portion by stretching of the elastic material when a vacuum is formed on the product packaged in the container and then allowing the liner layer to move back into the superimposed position within the body portion of the container by retraction of the elastic material when the container is opened and the vacuum on the product is removed.

5 Claims, 2 Drawing Sheets

COMPOSITE CONTAINER FOR VACUUM PACKAGING OF PRODUCTS

FIELD OF THE INVENTION

This invention is related to a composite container for vacuum packaging of products and having a loose liner therein for constricting and moving away from a container body portion when a vacuum is formed on the product packaged in the container and having a retraction system to move the liner back into superimposed position with the inside surface of the body portion of the container when the container is opened and the vacuum on the product is removed.

BACKGROUND OF THE INVENTION

Composite containers have been utilized in lieu of metal, plastic or glass containers in many instances for packaging of various products including food products due to their cost efficiencies, etc. If these products are packaged with an internal vacuum, problems have arisen with respect to the strength of the body portion of the composite container to maintain its shape after a vacuum is pulled on the product.

In an effort to overcome this problem, a loose liner system has been utilized in these composite containers, as disclosed in U.S. Pat. No. 4,158,425, assigned to the assignee of the present invention, the disclosure of which is incorporated herein by reference. As may be seen in this U.S. patent, a liner is utilized inside the composite container which is secured solely at the opposite ends thereof for a free inward collapsing of the liner with the product being packaged upon a vacuum being pulled on the product.

However, this composite container with a loose liner system produces additional problems. When the vacuum is released on the product after opening of the composite container, the incoming air does not push the liner back to its original position superimposed against the inside of the body portion of the container and the liner stays constricted or pulled up against the product. This causes the volume available to the product within the container to remain reduced and does not allow the product to settle back into the container. The product is at or near the opening of the container and causes difficulty in spooning or scooping the product without spillage. The product is also pressed against the liner and the end closures when under vacuum and embeds itself into these materials. When the vacuum is removed some of the product remains stuck to the liner and the end closures which causes product spillage. Also, the liner inside of the container looks baggy or loose when the product is removed, providing a bad impression to the customer.

OBJECT AND SUMMARY OF THE INVENTION

It is the object of this invention to provide a composite container for vacuum packaging of products which utilizes a loose liner system that can constrict and move away from the body portion of the container when a vacuum is formed on the product packaged in the container to prevent distortion of the shape of the container and which overcomes the problems discussed above with previous loose liner systems.

It has been found by this invention that the above object may be accomplished by providing a composite container for vacuum packaging of products which comprises the following components. A hollow body portion defines a desired shape for the container and has an inside surface. A liner layer is positioned within the body portion in superimposed condition with the inside surface for covering the inside surface and for receiving the product inside the liner layer and the body portion of the container. An elastic material is positioned between the body portion and the liner layer for attaching the liner layer to the body portion in the superimposed position while allowing the liner layer to constrict and move away from the body portion by stretching out the elastic material when a vacuum is formed on the product packaged in the container and then allowing the container to move back into superimposed position within the body portion of the container by retraction of the elastic material when the container is opened and the vacuum on the product is removed.

Preferably, the body portion of the container is formed by spirally winding of paperboard strips to form a generally cylindrical shape. End closures are preferably positioned on open ends of the body portion for hermetically closing the body portion. The liner layer is preferably a spirally-wound flexible hermetic layer. The elastic material may preferably comprise a coating of the elastic material substantially covering the inside surface of the body portion and the outside surface of the liner layer or the elastic material may comprise a pattern of deposits of such elastic material which may be either a predetermined pattern or a random pattern of dots, stripes, etc. The elastic material may preferably comprise any suitable elastic hot melt adhesive.

BRIEF DESCRIPTION OF THE DRAWINGS

In the drawings which form a part of the original disclosure of this invention.

DETAILED DESCRIPTION OF THE PREFERRED EMBODIMENTS

Figure 1:
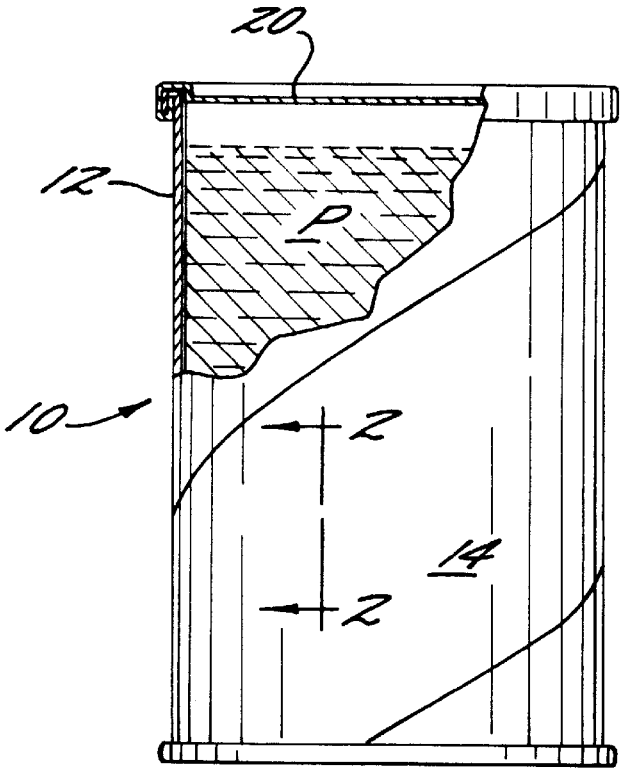
FIG. 1 is an elevational view of the container of this invention with a portion broken away.

In the following detailed description, the preferred embodiment or embodiments of the invention will be described. It is to be understood, however, that the invention is not to be limited to this preferred embodiment or embodiments and although specific terms are employed in describing these embodiments, these terms are for purposes of illustration only and not for purposes of limitation. It will be apparent that the invention includes various alternatives, modifications and equivalents within the spirit and scope as will be clearly understood to the skilled artisans.

Referring first to FIGS. 1–4, a composite container, generally indicated at 10, and constructed in accordance with this invention for vacuum packaging of products P is illustrated. This container 10 comprises a hollow body portion 12 defining a desired shape for the container 10 and having an inside surface 13. The body portion 12 of the container 10 is preferably formed by spirally-winding paperboard strips to define a generally cylindrical shape for the container. An outside label layer 14 may be utilized and preferably is spirally wound on the outside of the body portion 12 in a manner well understood by those with ordinary skill in the art (to be discussed more fully below).

The paperboard strip forming the spirally-wound hollow body portion 12 may be advantageously composed of conventional spirally-winding paperboard or board stock having a thickness of between 0.10 and about 0.35 inch, preferably between 0.1 5 and 0.30 inch, for example, 0.21 inch. Board stock conventionally used in the manufacture of spirally-wound composite containers is commercially available from various manufacturers including Sonoco Products Company, Republic Paperboard Corporation and Middletown Board Corporation. In order to function advantageously as the spirally-wound paperboard hollow body portion, the board stock typically is composed of kraft or recycled paper and can typically range from e.g. 50 to 100 lbs./ream. In some instances, the board stock can include a weak exterior layer, e.g. a 0.003 inch exterior news. The label layer 14 is conventionally constructed from suitable materials, such as kraft paper, a polymer/foil laminate, a kraft paper/foil laminate, or the like.

The container 10 also includes end closures 20 on each open end of the hollow body portion 12 for hermetically closing the hollow body portion 12. These end closures 20 may be double-seamed with the open end portions of the hollow body portion 12 in a manner well understood by those with ordinary skill in the art. The bottom end closure 20 may typically be constructed of steel or aluminum plate with applied coatings and/or electrolytic tinplate. Top closure 20 may be of a steel or aluminum plate with applied coatings and/or electrolytic tinplate with a center panel of a flexible laminate made of films, foil, and/or extruded polymers, or it may be made totally of a flexible laminate made of films, foil, and/or extruded polymers sealed heat-sealed or adhesively attached to the can body.

A liner layer 30 is positioned in superimposed relationship within the hollow body portion 12 and covers the inside surface 13 of the hollow body portion 12 for receiving the product P inside the liner layer 30 and the hollow body portion 12 of the container 10. The liner layer is preferably a flexible hermetic liner layer which may be spirally wound from a continuous strip and is secured to the body portion 13 at only the areas of the open ends thereof by any suitable means including an adhesive, heat setting and/or through double seaming of the liner layer 30 with the end closures 20 at the outer open ends of the body portion 12 as more fully disclosed in the above noted U.S. Pat. No. 4,158,425. The liner layer 30 may advantageously be a barrier type, flexible sheath, such as a polymer/foil, a kraft/foil/polymer, a polymer/polymer or a kraft/foil laminate.

Figure 3:
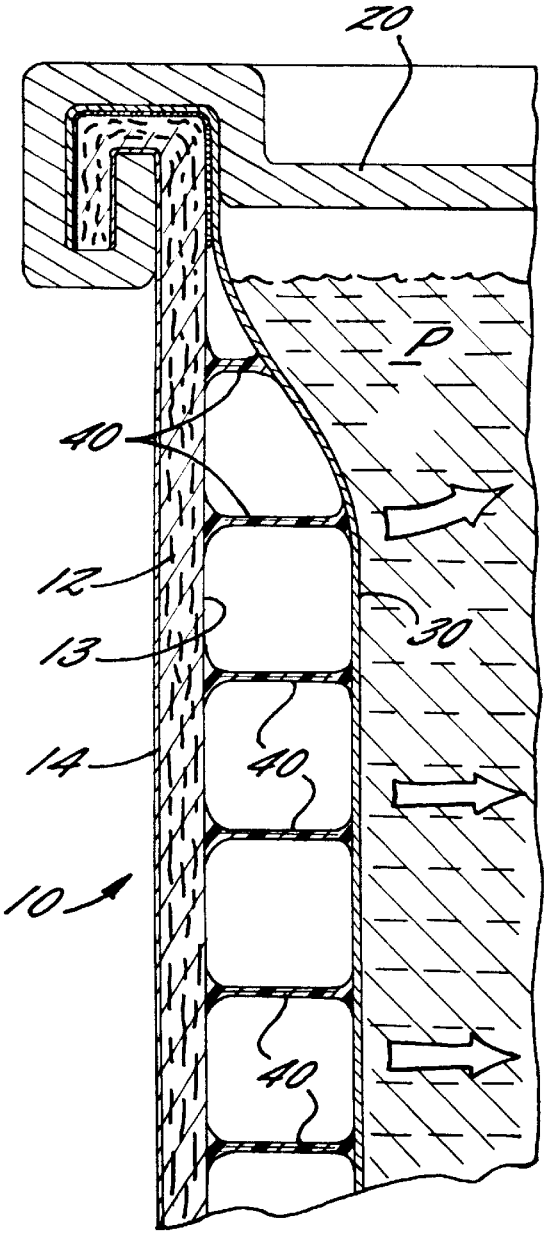
FIG. 3 is an enlarged partial sectional view of an upper left-hand corner of the container of FIG. 1 and illustrating the liner thereof in constricted position and moved away from the body portion of the container by stretching of the elastic material when a vacuum is formed on the product packaged in the container.
Figure 4:
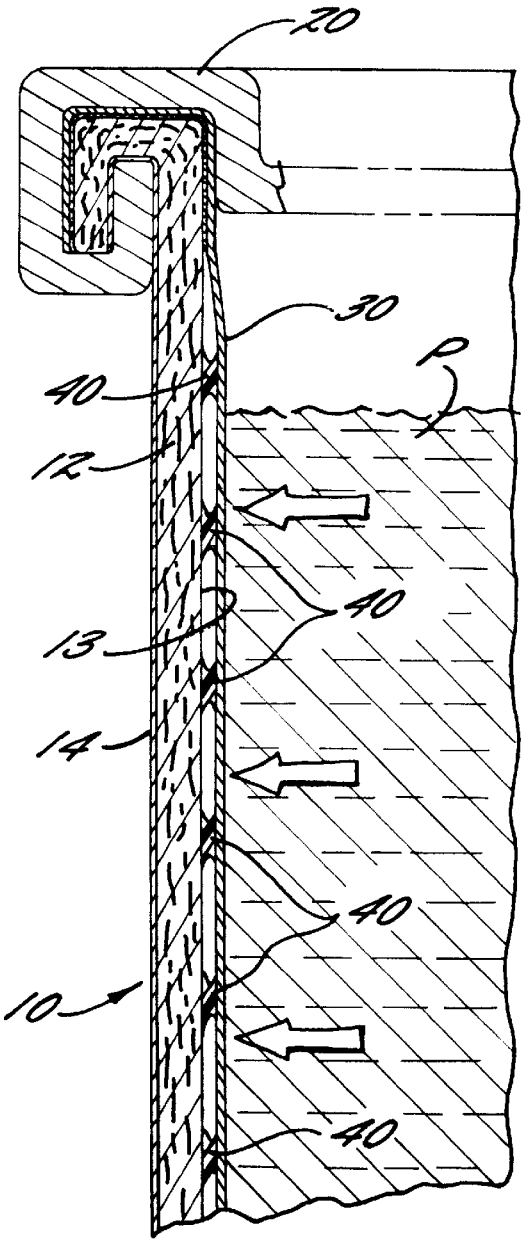
FIG. 4 is a view, like FIG. 1, and illustrating the container liner moved back into superimposed position within the body portion of the container by retraction of the elastic material when the container is opened and the vacuum on the product is removed.

In accordance with this invention, an elastic material 40 is positioned between the body portion 12 and the liner layer 30 between the areas of the open ends of the body portion 12 (where the liner layer 30 is preferably secured to the body portion 12) for movably attaching the liner layer 30 to the body portion 12 in the superimposed position. This elastic material 40 allows the liner layer 30 to constrict and move away from the body portion 12 by stretching of the elastic material 40 when a vacuum is formed on the product positioned in the container 10 (as illustrated in FIG. 3) and then allows the liner layer 30 to move back into superimposed position within the body portion 12 of the container 10 by retraction of the elastic material 40 when the container 10 is opened and the vacuum on the product P is removed (as shown in FIG. 4). This avoids the problems discussed above with respect to the previous loose liner systems in vacuum packaged composite containers of U.S. Pat. No. 4,158,425.

Figure 2:
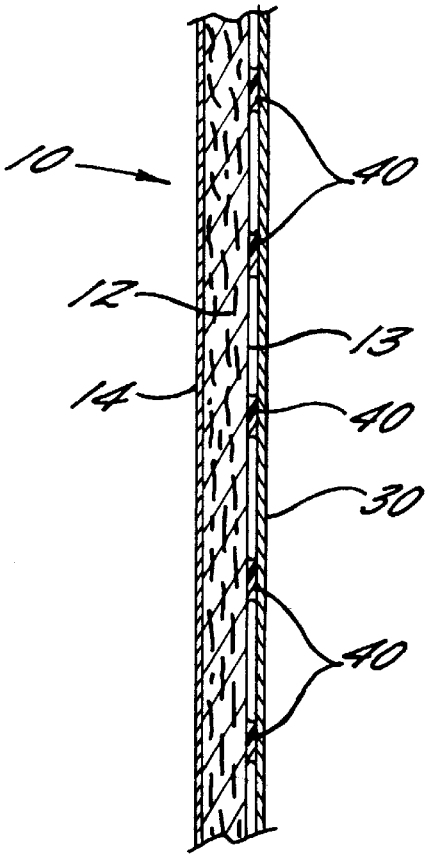
FIG. 2 is an enlarged partial sectional view taken generally along the line 2—2 of FIG. 1.
Figure 5:
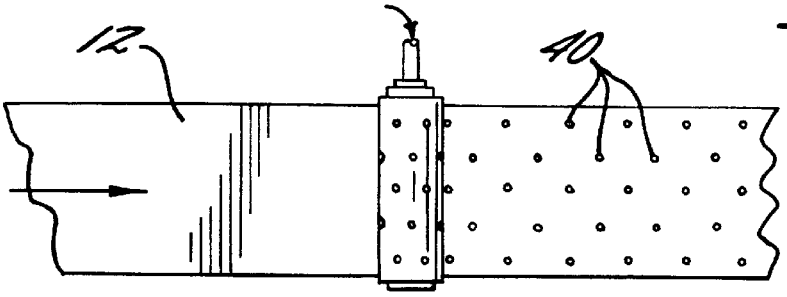
FIG. 5 is a view illustrating the application of elastic material in a structured pattern of dots to a paperboard strip utilized for forming the body portion of the container 10.
Figure 6:
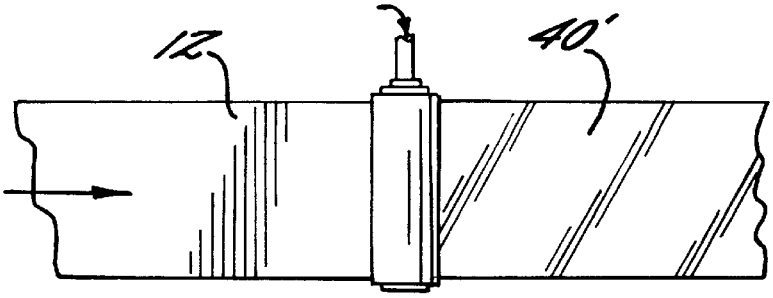
FIG. 6 is a view, like FIG. 5, illustrating the elastic material being applied in the form of a full coating to a paperboard strip utilized to form the body portion of the container.

The elastic material 40 may include any suitable type of elastic material which will stretch and retract to perform these desired functions discussed above and may include polymeric or rubber based hot melt adhesives, or elastic cold glues and the like. The elastic material 40 may be positioned between the body portion 12 and the liner layer 30 in any suitable pattern of deposits including a random or structured pattern of lines, dots, etc. or may be in the form of a full coating between the liner layer 30 and the body portion 12. As may be seen in FIG. 5, the elastic material 40 is being applied to a paperboard strip utilized to form the body portion 12 in a pattern of deposits in the form of a structured pattern of dots. In FIG. 6 the elastic material 40 is illustrated as being applied to a paperboard strip for forming the body portion 12 in a pattern of deposits in the form of a full coating. When the liner layer 30 is spirally wound onto the body portion 12, in a manner well understood by those with ordinary skill in the art, the elastic material 40 will be positioned therebetween, as illustrated in FIGS. 2, 3 and 4.

By this invention, a composite container 10 for vacuum packaging of products P has been provided which includes a liner layer 30 movably attached by elastic material 40 to the inside of a hollow body portion 12 and which can constrict and move away from the body portion 12 when a vacuum is formed on the product P packaged in the container 10 and which will move back into superimposed position with the body portion 12 of the container 10 when the container is opened and the vacuum on the product is removed. This construction overcomes the prior problems with composite containers for vacuum packaging of products.

The invention has been described in considerable detail with reference to its preferred embodiment or embodiments. However, variations and modifications can be made within the spirit and scope of the invention, as described in the foregoing specification and as is defined in the following claims.

What is claimed is:

1. A composite container for vacuum packaging of products and comprising a hollow body portion defining a desired shape for the container and having an inside surface;

a liner layer in superimposed position within said body portion and covering said inside surface for receiving the product inside said liner layer and said body portion of said container; and an elastic material which will stretch and retract positioned between said body portion and said liner layer for movably attaching said liner layer to said body portion in the superimposed position while allowing said liner layer to constrict and move away from said body portion by stretching of said elastic material when a vacuum is formed on the product packaged in said container and then allowing said liner layer to move back into superimposed position within said body portion of said container by retraction of said elastic material when the container is opened and the vacuum on the product is removed.

2. A composite container for vacuum packaging of products and comprising a spirally-wound paperboard hollow body portion defining a generally cylindrical shape for the container and having an inside surface and open outer ends;

end closures on each open end of said body portion for hermetically closing said body portion;

a flexible hermetic liner layer in superimposed position within said body portion and covering said inside surface and being secured to said body portion at the areas of said open ends for receiving the product inside said liner layer and said body portion of said container; and an elastic material which will stretch and retract positioned between said body portion and said liner layer between the areas of said open ends for movably attaching said liner layer to said body portion in the superimposed position while allowing said liner layer to constrict and move away from said body portion by stretching of said elastic material when a vacuum is formed on the product packaged in said container and then allowing said liner layer to move back into superimposed position within said body portion of said container by retraction of said elastic material when the container is opened and the vacuum on the product is removed.

3. A container, as set forth in claim 1 or 2, in which said elastic material is in the form of a coating of said elastic material.

4. A container, as set forth in claim 1 or 2, in which said elastic material is in the form of a pattern of deposits of said elastic material.

5. A container, as set forth in claim 1 or 2, in which said elastic material comprises an elastic hot melt adhesive.

* * * * *